United States Patent [19]

Austin et al.

[11] 4,023,493

[45] May 17, 1977

[54] FIRELINE DETONATOR

[75] Inventors: Carl F. Austin, Inyokern; Carl C. Halsey; Samuel E. Kendall, both of China Lake, all of Calif.

[73] Assignee: The United States of America as represented by the Secretary of the Navy, Washington, D.C.

[22] Filed: Sept. 24, 1975

[21] Appl. No.: 616,236

[52] U.S. Cl. ..... 102/22 R; 102/27 R

[51] Int. Cl.[2] ..... F42B 3/10

[58] Field of Search ..... 102/22–24, 102/27 R; 106/15 FP; 252/4, 5, 7

[56] References Cited

UNITED STATES PATENTS

| | | | |
|---|---|---|---|
| 3,356,024 | 12/1967 | Driscoll et al. | 102/28 |
| 3,654,190 | 4/1972 | Levine | 252/5 |
| 3,675,574 | 2/1972 | Moreau | 102/28 |
| 3,749,024 | 7/1973 | Pakulak, Jr. | 102/24 R |

OTHER PUBLICATIONS

Safety and Durability Tests of the Fireline Explosive Cord by Carl F. Austin et al., Sept. 1973.

*Primary Examiner*—Verlin R. Pendegrass
*Attorney, Agent, or Firm*—R. S. Sciascia; Roy Miller

[57] ABSTRACT

A compact, reliable, nonincendiary fireline cord detonator is disclosed which attaches without tools to a length of explosive fireline cord utilized to clear a path through a wooded or brush covered area. The detonator uses an exploding bridgewire squib to protect against a premature explosion caused by static electricity or electric current induced by spurious electromagnetic radiation.

4 Claims, 2 Drawing Figures

FIRELINE DETONATOR

BACKGROND OF THE INVENTION

This invention relates to exploding bridgewire detonators, and more particularly to nonincendiary detonators adapted to easily connect with explosive fireline cord.

Fireline cord is an explosive tool presently utilized for clearing grass, brush or forest litter along a line to form an open barrier to a spreading fire. U.S. Pat. No. 3,830,156 to Sewell et al. describes one embodiment of fireline cord which is constructed of strands of explosive material surrounded by fire retardant solution within a long semi-rigid housing. The fireline cord is deployed along the path to be cleared, and detonated. The blast clears the path of combustible material and at the same time disperses a fire retardant solution over a wide area to prevent new fires which may be caused by heat and flame from tne explosive blast.

Previously, electric blasting caps were used to detonate fireline cords by taping a cap to the exterior surface of the cord housing and exploding it using some electrical means, usually a magneto or a condenser discharge blasting machine. Electric blasting caps, however, have certain disadvantages. They can be set off prematurely by static electricity which may build up on the cap and be suddently discharged across the blasting cap filament, or by electric current induced by spurious electromagnetic radiation. Both of these hazards are present in a forest fire situation where dust or fine smoke particles in the air acquire static charges and may transfer them to the cap, or where portable radio transmitters carried by firefighters may induce sufficiently strong electric currents in the filaments to explode the caps. In addition, the caps are not designed specifically for use with fireline cord and so must be taped to the exterior surface of the cord requiring the user to carry a roll of tape. If the cap is not attached properly, a misfire may result. Because a high percentage of misfires occurs using this technique the firefighter must carry extra caps in order to be certain that he has sufficient caps to detonate all available fireline cords, thus increasing the danger of a premature explosion which could result in personal injury or death to the firefighter.

SUMMARY OF THE INVENTION

Accordingly the general purpose of the invention is to provide an apparatus which uses an explosive bridgewire squib within a lightweight housing containing a booster charge and which attaches easily to the end of a length of presently manufactured fireline cord. The detonator so constructed is coated to suppress incendiary action of the booster charge.

One embodiment of the inventon uses standard commercially available plastic pipe and fittings to form a housing which attaches to a length of fireline cord, similarly constructed from standard plastic pipe and fittings. Within the housing an exploding bridgewire, which requires high amperage to fire, is used to initiate a primary explosion thereby causing a booster charge also within the detonator housing to explode. The close proximity of the booster charge to the fireline cord explosive material causes the fireline cord to explode.

The detonator disclosed herein eliminates the need for attaching tools, is easily manufactured from standard components, is safe in areas of high static electricity or electromagnetic radiation, will reliably detonate fireline cord, and will not start fires when detonated.

BRIEF DESCRIPTION OF THE DRAWINGS

For a better understanding of the invention reference is made to the accompanying drawings, in which.

DETAILED DESCRIPTION OF AN EMBODIMENT

Figure 2:
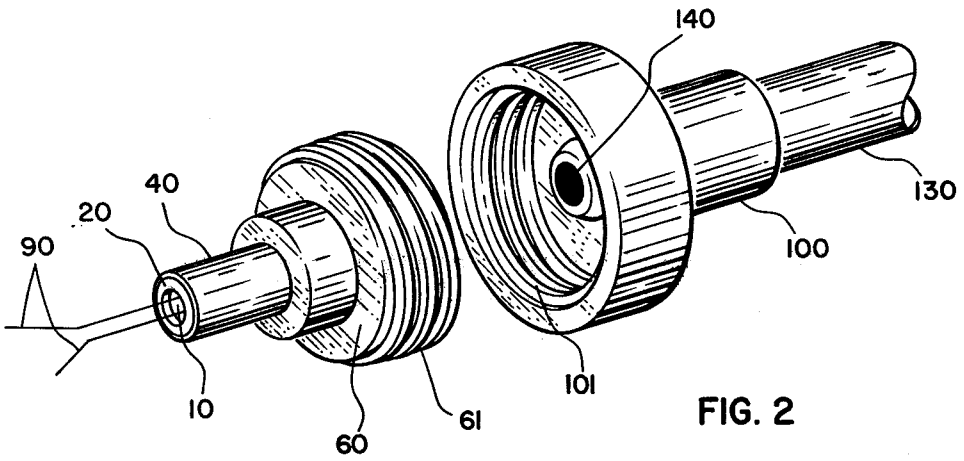
FIG. 2 is a perspective view of an embodiment of the invention before application of the inhibiting coating 80.
Figure 1:
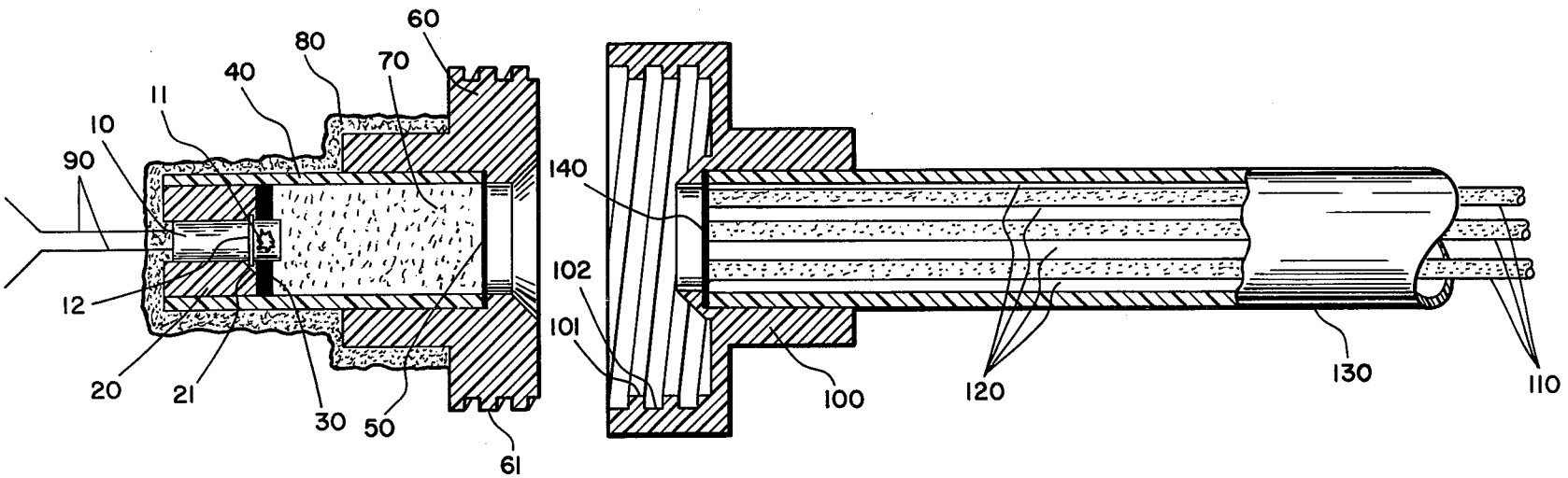
FIG. 1 is a sectional view of an embodiment of the invention.

Referring now to the drawings wherein like reference characters throughout the various figures refer to like parts and elements, there is shown in FIG. 1 a cylindrical tube 40 with a thin frangible cover 50 on one end. Tube 40 and cover 50 are cemented together using a type of cement that is compatible with the materials of these elements and with explosive booster charge 70 that is placed within the closed end of tube 40.

The explosive used for booster charge 70 is pentaerythritol tetranitrate (hereinafter PETN). PETN was selected for the explosive because it is currently inexpensive, reliable, and presents a less severe flame problem than other explosives. Also the PETN explosion propagates well along a length and thus is suitable for the cord as well as the booster charge. Other similar explosive materials may be used with good results. Incendiary action suppressing chemicals such as potassium acid tartrate (hereinafter KHT) may be mixed with PETN or other explosives to reduce fire danger.

Most epoxy type adhesives react with PETN and therefore are unsuitable for use on tube 40 and cover 50. It is desirable, however, to use standard plastic pipe materials which are comercially available for the parts wherever possible. Fortunately standard plastic pipe cement is compatible with PETN although any equivalent adhesive will work.

The closed end of tube 40 containing booster charge 70 is inserted into the open end opposite the threaded end of male threaded connector 60 and fastened in place by appropriate means such as cementing or the like. Any of many different kinds of presently manufactured mechanical connectors may be employed to retain tube 40 within connector 60 and although connector 60 is shown with threads, it is to be understood that any other fastening means may be used, as long as there are suitable connection means to mate or match it to the connectin means on fireline cord 130.

A retaining ring 30 placed within tube 40 contacts and retains booster charge 70 in place. Explosive bridgewire squib assembly 10 is then inserted into tube 40 so that the end of squib 10 containing primary charge 11 enters a centrally located hole in retaining ring 30. This hole is approximately the same diameter as the body diameter of explosive bridgewire squib 10 for maintaining a close fit between these members.

Exploding bridgewire squib assembly 10 has a tubular body with a raised annular ring 12 formed therein at a fixed distance from the end containing primary charge 11. As squib 10 enters retaining ring 30 charge 11 contacts booster charge 70 and is prevented from overinsertion by raised annular ring 12 which abuts retaining ring 30, thereby limiting the distance squib 10 may enter booster charge 70. Squib assembly 10 also has two electrically insulated wires 90 which project from the squib end opposite the primary charge 11.

These wires supply electricity to explode the bridgewire located inside squib assembly 10 and adjacent primary charge 11.

Squib assembly 10 and retaining ring 30 are rigidly reinforced and held in their relative positions against booster charge 70 by hollow cylindrical plug 20 which has an outside diameter approximately equal to the inside diameter of tube 40 and an inside diameter approximately equal to the outside diameter of squib assembly 10 adjacent to raised annular ring 12. The inside diameter of plug 20 at the end which contacts retaining ring 30 has a chamfer or recess to accomodate the thickness and diameter or annular ring 12. This chamfer enables plug 20 to contact both retaining ring 30, and the side of annular ring 12 facing away from booster charge 70. Forces causing squib assembly 10 to pull out of tube 40 are resisted by the chamfered area of plug 20 bearing against the side of annular ring 12 on squib 10. Plug 20 is appropriately fastened, for example cemented, to the inside of tube 40.

The exposed exterior surfaces of tube 40 and connector 60 as well as plug 20 and squib 10 are coated with a layer of inhibiting coating 80. This material quenches the heat and flame from the explosion and prevents a new fire when the detonator is exploded. Coating 80 should have a thickness of from one eighth to one quarter inch for optimum protection. Coating 80 is a mixture of potassium acid tartrate and a binder such as rubber or plastic. It is mixed to form a paste and applied to the exterior of the detonator where it cures to form a durable coating.

Fireline cord similar to that described in U.S. Pat. No. 3,830,156 to Sewell et al. is shown in FIG. 1 constructed of long flexible outer housing 130 containing one or more strands of explosive material 110 positioned within housing 130 along its length. Surrounding explosive strands 110, is fire retardant solution 120 which may be water, or any commercial fire retardant. Solution 120 is retained in housing 130 by seal 140. Explosive strands 110 are disposed within housing 130 by contact with seal 140 on the end to be detonated. Other embodiments of fireline cord use a flexible cloth housing and strands of PETN/KHT mixture, omitting fire retardant solution 120.

An end of the fireline cord is inserted and attached within female threaded connector 100. Once again, any fastening means, such as cement or the like, may be used. Female connector 100 is constructed with threads 101 that mate with threads 61 on male connector 60.

In practice the detonator is completely assembled and carried separately from the fireline cord which has female threaded connector 100 permanently attached to it. Whenever a firefighter desires to clear a path through small trees or brush he deploys a fireline cord. Male connector 60 on a detonator is brought into contact with female connector 100 on a fireline cord and rotated clockwise until screw threads 61 occupy grooves 102 on female connector 100 and the two elements are threaded together, the detonator seating tightly against female connector 100. This allows a separation distance between booster charge 70 and the end of explosive strands 110 of approximately one quarter inch or less (6.35mm). This is necessary for consistent detonation of explosive strands 110 whenever PETN is used for booster charge 70. It is to be understood that other explosives may be used and that different optimum distances between booster dharge 70 and cord explosive 110 may be necessary to obtain reliable detonation of the fireline cord.

Additional long wires, not shown, are attached to wires 90 projecting from the detonator, and strung to a place shielded from the impending blast. They are then attached to a condenser discharge blasting machine or like device, not shown. When detonation is desired the device is activated to electrically explode the bridgewire within squib 10, causing primary charge 11 to ignite and set off booster charge 70. The detonating wavefront from booster charge 70 ruptures cover 50 and seal 140 to cause detonation of explosive strands 110.

What is claimed is:

1. An explosive fireline cord detonator comprising:

a tube having first and second ends;

a cover rigidly attached to said first end of said tube for closing said end;

an explosive booster charge retained within said tube abutting said closed first end;

an apertured partition retained within said tube, spaced from said closed first end, abutting said booster charge;

an explosive bridgewire squib retained within said tube in contact with said booster charge through said aperture in said partition;

an annulus around said squib attached at a level so as to limit the penetration of the squib into the partition aperture;

a retaining plug attached within said tube, for holding said squib in contact with said booster charge;

a connector rigidly attached to said tube at said first end; and a cohesive coating, having flame retardant properties, surrounding and adhering to said detonator for suppressing flame and heat caused by detonation of said booster charge;

so constructed and arranged that said detonator may be carried separately from and rapidly attached to said fireline cord.

2. The explosive fireline cord detonator of claim 1 wherein said booster charge contains pentaerythritol tetranitrate.

3. The explosive fireline cord detonator of claim 1 wherein said coating comprises potassium acid tartrate and a binder.

4. The combination with the explosive fireline cord detonator of claim 1 of a length of fireline cord comprising:

an elongated housing:

at least one strand of explosive material retained within said housing; and a flame suppressant material surrounding said strand, contained within said housing.

* * * * *